US005921484A

United States Patent [19]

Smith et al.

[11] Patent Number: 5,921,484

[45] Date of Patent: Jul. 13, 1999

[54] WEAR RESISTANT ROCK CRUSHER IMPELLER AND METHOD

[75] Inventors: Jerry I. Smith, Husum; Anthony E. Stout, Dallesport, both of Wash.

[73] Assignee: Smith and Stout Research and Development, Inc., Husum, Wash.

[21] Appl. No.: 08/868,781

[22] Filed: Jun. 4, 1997

[51] Int. Cl.[6] ..... B02C 19/00

[52] U.S. Cl. ..... 241/275

[58] Field of Search ..... 241/275, 5, 300

[56] References Cited

U.S. PATENT DOCUMENTS

| | | | |
|---|---|---|---|
| Re. 32,355 | 2/1987 | Warren et al. | 241/300 |
| 3,000,579 | 9/1961 | Bridgewater | 241/275 |
| 3,032,169 | 5/1962 | Bridgewater | 198/128 |
| 3,074,657 | 1/1963 | Bridgewater | 241/275 |
| 3,149,793 | 9/1964 | Bridgewater | 241/275 |
| 3,162,386 | 12/1964 | Danyluke | 241/275 |
| 3,174,697 | 3/1965 | Bridgewater | 241/275 |
| 4,090,673 | 5/1978 | Ackers et al. | 241/275 |
| 4,326,676 | 4/1982 | Rose | 241/275 |
| 4,355,769 | 10/1982 | Warren et al. | 241/300 |
| 4,699,326 | 10/1987 | Warren | 241/275 |
| 4,784,339 | 11/1988 | Deffenbaugh | 241/275 |
| 4,787,564 | 11/1988 | Tucker | 241/275 |
| 5,137,220 | 8/1992 | Rose et al. | 241/275 |
| 5,174,513 | 12/1992 | Rose et al. | 241/275 |
| 5,184,784 | 2/1993 | Rose et al. | 241/275 |
| 5,201,469 | 4/1993 | Urschel | 241/5 |
| 5,323,974 | 6/1994 | Watajima | 241/275 |
| 5,533,685 | 7/1996 | Heck | 241/275 |

FOREIGN PATENT DOCUMENTS

| | | |
|---|---|---|
| 668646 | 8/1963 | Canada . |
| 0 166 673 | 1/1986 | European Pat. Off. . |
| 0 562 194 | 9/1993 | European Pat. Off. . |
| 6-402 | 6/1994 | Japan . |
| 478604 | 9/1975 | Russian Federation . |

*Primary Examiner*—Mark Rosenbaum
*Assistant Examiner*—William Hong
*Attorney, Agent, or Firm*—Flehr Hohbach Test Albritton & Herbert

[57] ABSTRACT

A rock crusher (10) including a turntable (26) with a series of impellers (34) mounted thereon. Each impeller (34) includes a curved, C-shaped pocket (56) that includes a radially inwardly sloped wall (59) terminating in a transversely extending lip (111). The impeller (34) is oriented in a somewhat closed position or greater angle of attack (90) so that the front face (54) of the impeller is exposed to oncoming rocks. A method of retaining rock fines (116) in a pocketed impeller (34) of a rock crusher (10) which includes orienting a radially outermost pocket wall (59) in a radially inwardly sloped orientation is disclosed.

10 Claims, 6 Drawing Sheets

WEAR RESISTANT ROCK CRUSHER IMPELLER AND METHOD

TECHNICAL FIELD

This invention pertains to centrifugal impact rock crushers and, more particularly, to an improved pocketed impeller blade or ejector for the turntables of such crushers and a method for retaining rock fines in the impeller pockets.

BACKGROUND ART

A centrifugal impact rock crusher is a device that accepts large size rocks, for example rocks approximately 2–5 inches in diameter, and breaks them apart into small, pieces, such as pieces approximately 1 inch or less in diameter. In operation, large rocks are fed downwardly through a hopper and feed tube and onto a feed cone at the center of an impeller turntable. A series of spaced impeller blades or members are positioned along the periphery of the turntable just off the feed cone. After landing on the feed cone, the rocks are deflected radially outwardly off of the feed cone and into the path of the rotating impellers. The impellers catch the rocks and throw them with tremendous centrifugal force radially outwardly and violently against fixed anvils. The turntable is positioned inside a large cylindrical housing that has a ring of anvils fixedly mounted along the inside of the housing wall in vertical alignment with the impellers. When the rocks strike the anvils, they crack under their own momentum into relatively uniform, often cubical, pieces and freely fall down onto a conveyor or other suitable output device, such as a receptacle.

The impeller blades of prior art rock crushers are generally wedge-shaped rectangular blocks that are mounted to the turntable with their narrow wedge ends adjacent or even partially overlapping the feed cone and their wide ends at the outer edge of the turntable. The purpose of the impellers is not to break apart the rocks, but to catch or grab the rocks and throw them outwardly against the anvils, which are fixedly mounted along the circumferential wall surrounding the turntable. While the anvils are designed to withstand tremendous impact forces, the impellers are mainly designed to withstand abrasion forces associated with slinging of the rocks outwardly against the anvils. Abrasion is caused not only by the rocks themselves, but also by the "fines" associated with the rocks. Fines includes dust and sand particles, dirt and mud, smaller rock fragments all of which may be carried by the large rock pieces into the rock crushing device.

It has been proposed to reduce wear on the impellers by creating a pocket within the impact or wear surface of the impeller. With pocketed impellers, fines collect in the pocket and thereby create a renewable wear surface of fines that contacts the rocks. As the rocks are slung by the impellers, the rocks sweep away a portion of the fines from the pocket. However, additional fines carried by the rocks subsequently refill the pocket. Canica-Jaques of Vancouver, Wash., U.S.A., for example, makes a rock crusher impeller with two radially adjacent pockets in the impeller wear surface. This type of rock crusher impeller, however, is limited in the size and type of rock that it can crush—rocks no larger than about 2½ inches in diameter and relatively soft rock, such as limestone, cement, sulfur, etc. are best suited for crushing using the Canica-Jaques pocketed impellers. The Canica-Jaques' impellers also require rock material with a high fines content in order to replace the fines swept out of the pockets by the rocks, and with high moisture content in order to help hold the fines in the pockets.

However, prior art pocketed impellers have not been found to work satisfactorily with certain types of rock, namely, large, relatively hard and dry rock material. The present invention is designed to address these limitations of prior art centrifugal impact rock crusher impellers.

DISCLOSURE OF INVENTION

A rock crusher and an improved pocketed impeller for a rock crusher are provided which include, briefly, a rotatable turntable, a series of impellers mounted for rotation on the turntable, a ring of stationary anvils positioned around and radially outwardly of the impellers. The improved impeller is formed with a pocket in a forwardly facing wear surface which engages and propels the rocks. The pocket is formed to have an enhanced ability to trap and retain rock fines in the pocket. More particularly, the pocket includes a radially outermost wall that is inwardly sloped or tilted when the impeller is attached to the rock crusher turntable. This inward tilt or negative slope traps rock fines against being swept from the pocket under centrifugal forces. Moreover, the incoming rocks tend to pack the fines trapped in the pocket.

The invention also includes the method of trapping fines in a pocketed impeller which is comprised of the step of securing the impeller to the rock crusher turntable with a radially outermost wall of a fines-trapping pocket oriented to be radially inwardly sloped.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
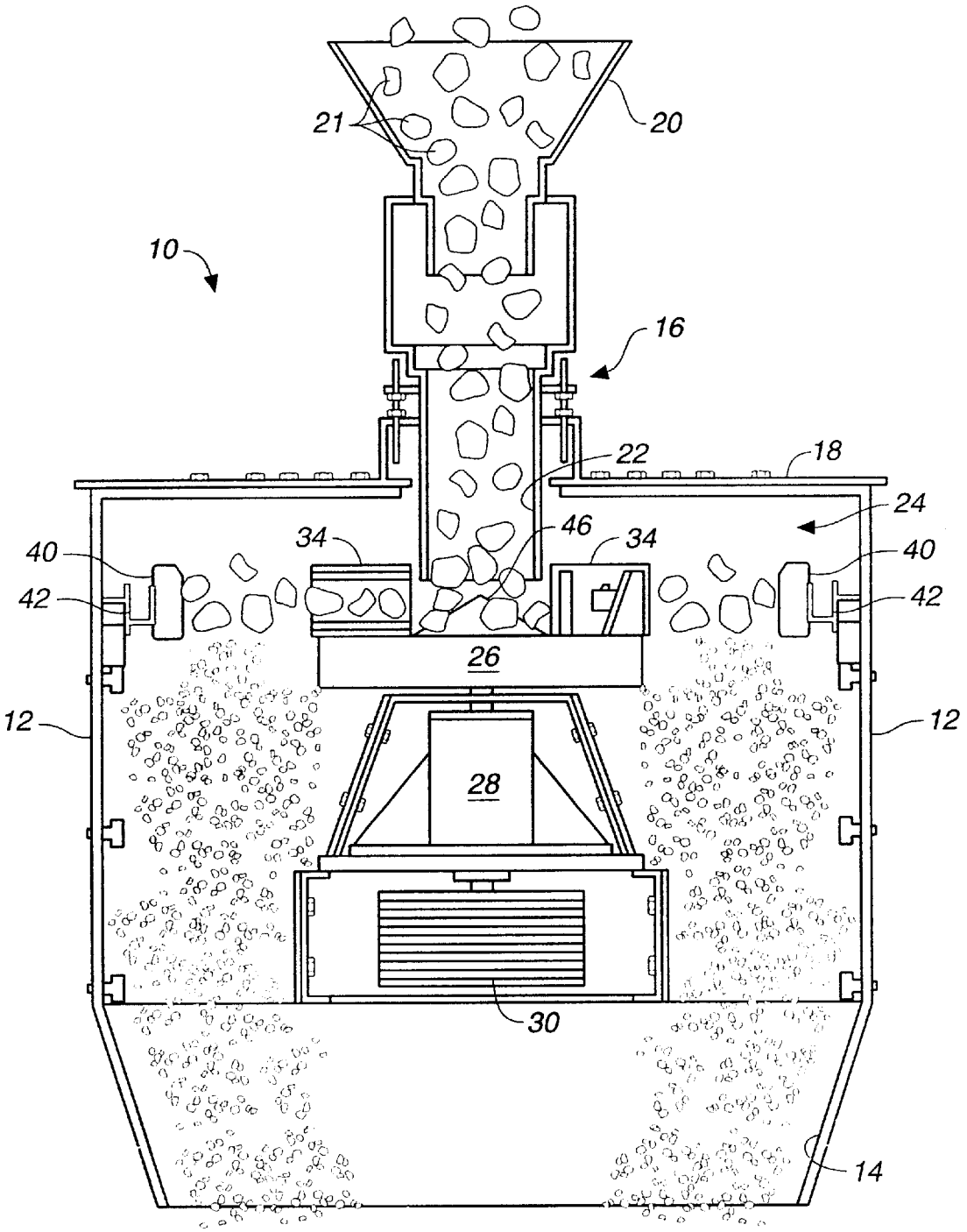
FIG. 1 is a schematic side elevation view, in half section, of a centrifugal impact rock crusher employing the improved impellers of the present invention.

A rock crusher, generally designated 10, is shown schematically in FIG. 1 and includes a cylindrical housing 12 with an open bottom 14 and a top that is closed by a feed device 16 and an annular lid 18. Feed device 16 includes a hopper 20 and a feed tube 22 that are centrally positioned of lid 18. As shown in FIG. 1, hopper 20 and feed tube 22 introduce large size rocks 21, or other material to be crushed, into the interior chamber 24 formed by cylindrical housing 12.

At the center of interior chamber 24 is a round turntable 26, which is rotatably supported by a bearing assembly 28. Turntable 26 is positioned directly below feed tube 22 and in position to receive rocks 21 from the feed tube. A suitable drive means 30, such as a motor and pulley assembly, rotates turntable 26 at a desired RPM, for example, 1000 to 2000 RPM.

A series of impeller blades or ejectors 34 are mounted in spaced relationship about the outed periphery of the turntable. The design of impeller blades 34 comprise an important aspect of the present invention and is discussed in more detail with reference to FIGS. 3–10.

A ring of anvils 40 (only two anvils shown in FIG. 1) surround turntable 26 and are vertically aligned with impellers 34. Anvils 40 are mounted to brackets 42, which in turn secure the anvils to the side wall of housing 12. The operation of rock crusher 10 is discussed in more detail with reference to FIG. 10.

Figure 2:
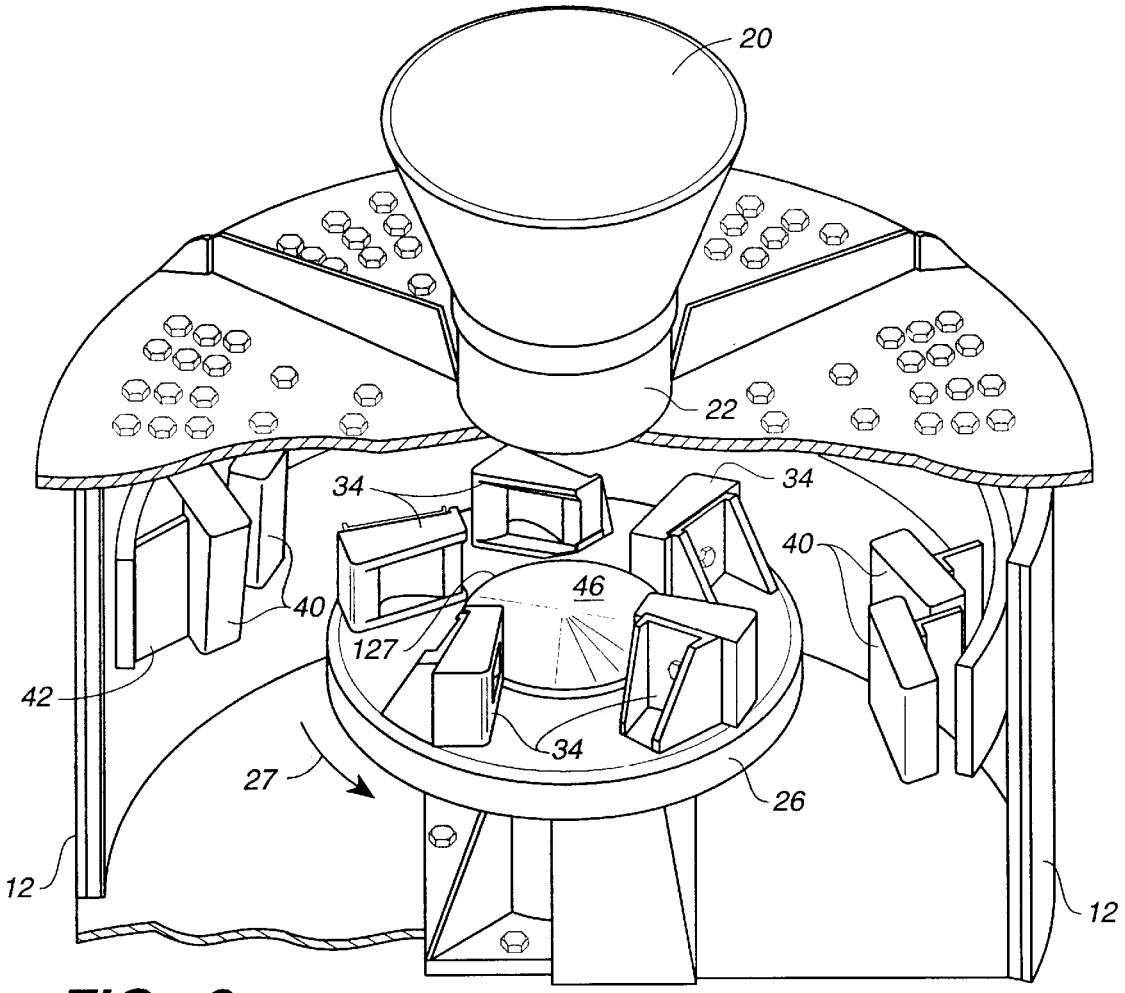
FIG. 2 is a cut-away pictorial view of the rock crusher of FIG. 1.

Referring to FIG. 2, five impellers 34 are mounted to turntable 26. Impellers 34 are equally spaced and are mounted at the periphery of turntable 26 at the edge of a feed cone 46. Feed cone 46 forms the center region of turntable 26 and is formed as a slightly raised conical member. The slope of conical feed cone 46 causes rocks to be deflected outwardly into the path of travel of impellers 34 upon dropping of rocks 21 onto the turntable. Feed cone 46 may or may not be rotated with turntable 26.

Figure 4:
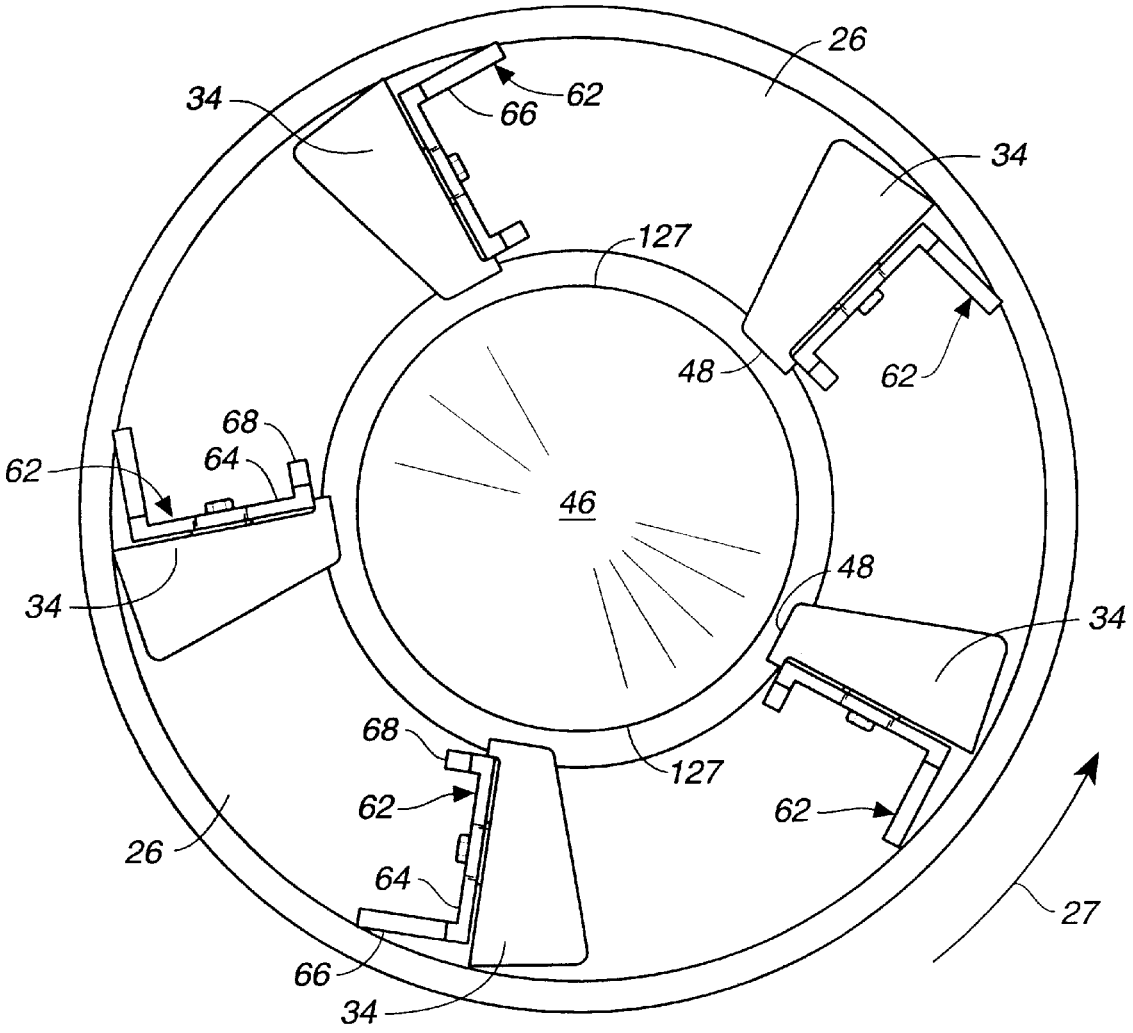
FIG. 4 is a top plan view of the turntable on which five impellers like the impeller of FIG. 3 are mounted.
Figure 10:
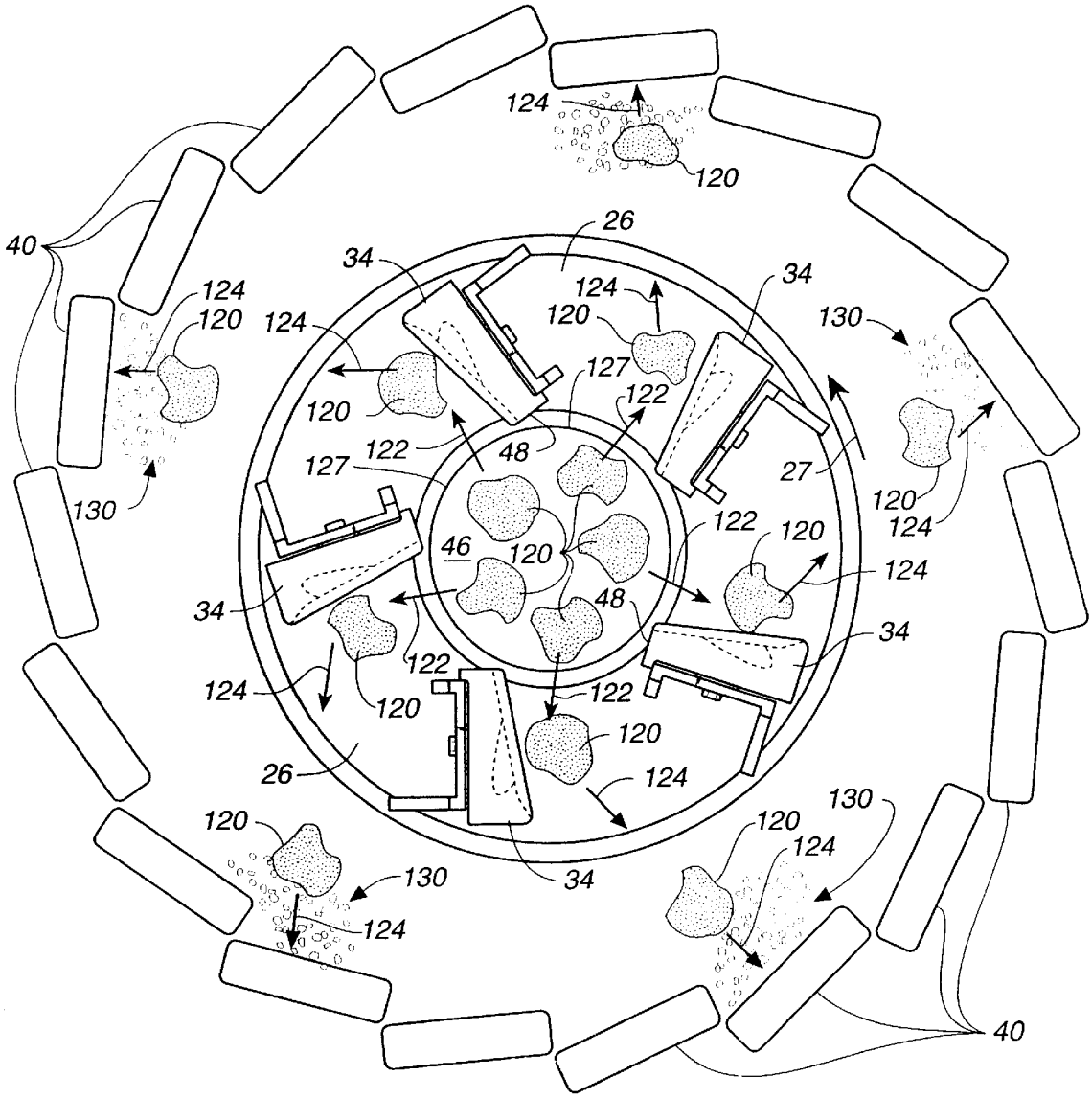
FIG. 10 is a schematic top plan view of the turntable, its impellers and the anvils of the rock crusher of FIG. 1, showing the outward movement of rocks past the impellers and against the anvils.

It can also be seen in FIG. 2 that anvils 40 are angled to one side. While only a pair of anvils 40 are shown on each side of housing 12, anvils 40 comprise a ring of anvils that surround turntable 26, as best seen in FIG. 10. Turntable 26 is shown in FIGS. 2, 4 and 10 as rotating in a counterclockwise direction, as indicated by arrow 27, which moves the impellers on an arcuate path, causing the rocks to be propelled by the impellers with a counterclockwise component of travel. Anvils 40 are angled so as to directly face the outwardly traveling rocks. The angle of the anvils is shown and discussed in more detail with reference to FIG. 10.

Figure 3:
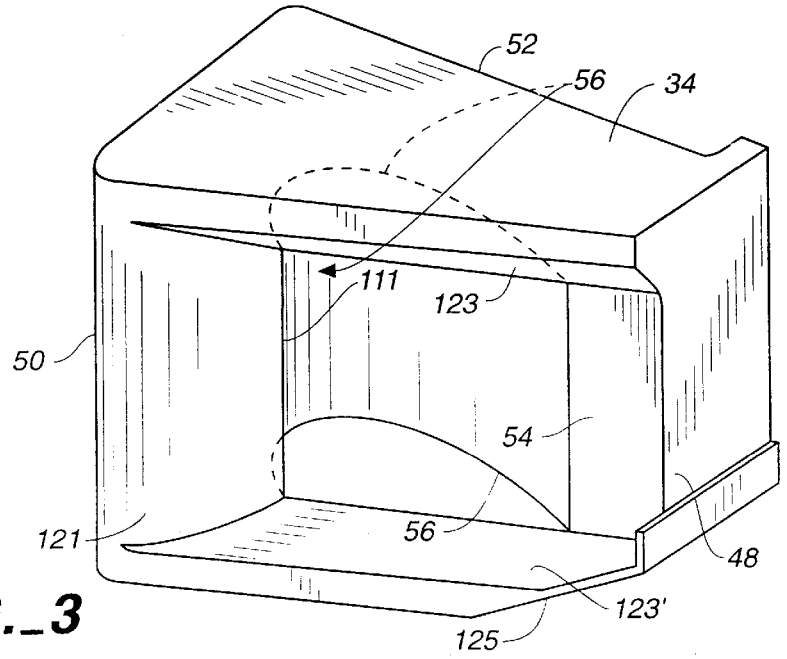
FIG. 3 is pictorial view of the impeller of the present invention.

FIG. 3 shows the improved design of an impeller 34 of the present invention. Impeller 34 is generally a wedge-shaped and rectangular member having a narrow end 48 and a wide end 50. The back side 52 of impeller 34 is mounted to a bracket, discussed later, which in turn secures the impeller to turntable 26. The front or forwardly facing wear face 54 is the side of impeller 34 that contacts the rocks. A curved, somewhat C-shaped pocket 56 is formed in front side 54.

The present invention resides in the improved design of pocket 56. Accordingly the material of which impeller 34 is made can be any conventional high strength, impact resistant material commonly used for rock crusher impellers, most commonly, high-impact, abrasion-resistant, cast white iron.

Figure 5:
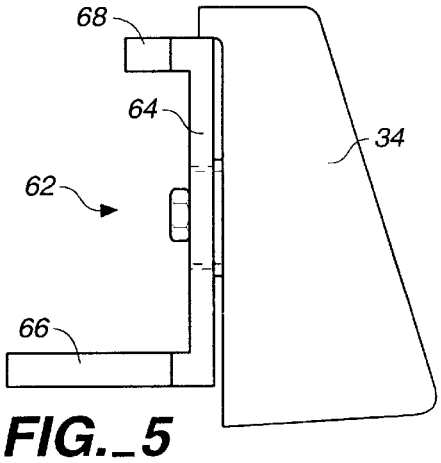
FIG. 5 is a top plan view of the impeller of FIG. 3 shown mounted to a mounting bracket, which secures the impeller to the turntable.
Figure 6:
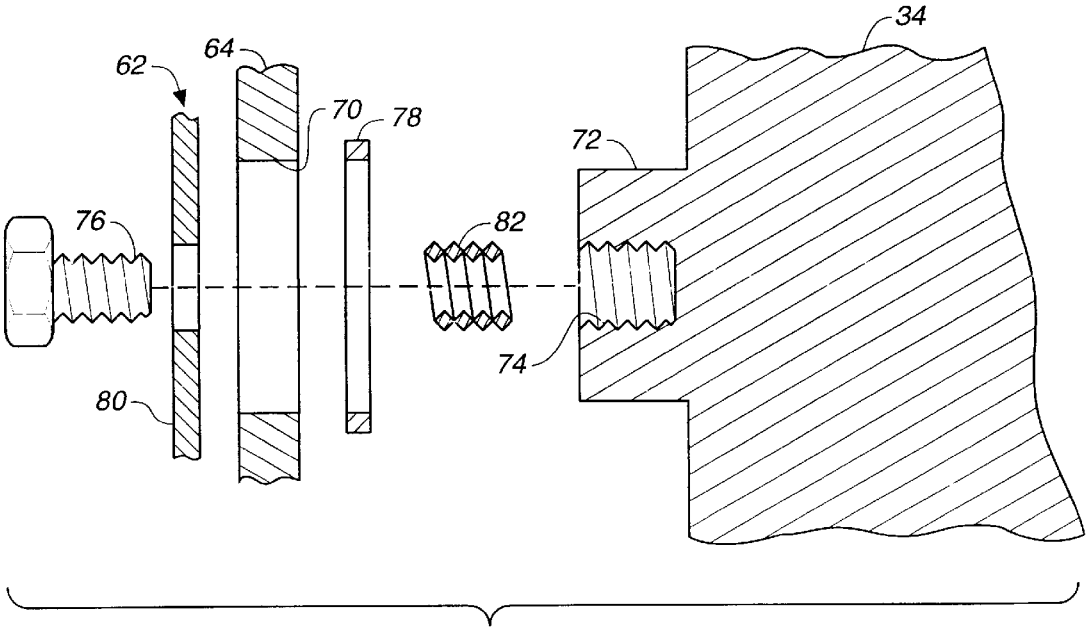
FIG. 6 is an exploded, fragmentary view of the mounting arrangement for securing the impeller of FIG. 5 to its mounting bracket.

FIGS. 4–6 show the mounting brackets, generally designated 62, that secure impellers 34 to turntable 26. Each mounting bracket 62 includes an upright section 64, a large, outer gusset 66, and a small, inner gusset 68. Each mounting bracket 62 also includes a central opening 70 (FIG. 6) in upright section 64, which opening is sized to closely receive a hub extension 72 of impeller 34. Hub extension 72 includes an internally threaded passageway 74, which threadably receives a headed bolt 76 to secure impeller 34 to bracket 62. A spacer washer 78 fits around hub extension 72 and a larger mounting washer 80 is positioned between bolt 76 and bracket 62. A compressible helicoil 82 screws into the cast threads of passageway 74 to provide a more uniform threaded fit with the machined threads of bolt 76. It should be noted that the above-described mounting arrangement for each impeller is exemplary and that other suitable designs should be apparent to those skilled in the art, for example, double helicoil systems and transverse pin-based systems.

Figure 7:
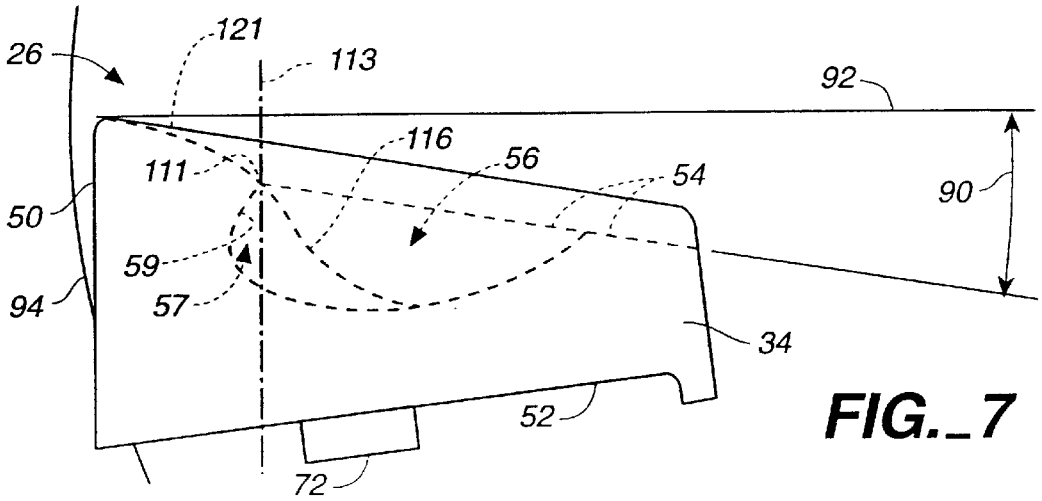
FIG. 7 is a schematic view of the impeller of FIG. 3 showing its angle of attack relative to a radial line of the turntable.

FIG. 7 illustrates the angle of attack of wear surface 54, represented by the included angle arrow 90, of an impeller 34. Angle of attack 90 is the angle between a radial line 92 and the front side 54 of impeller 34. Radial line 92 represents a radial line of turntable 26, extending from the center of the turntable to the turntable's outer edge 94. Each impeller of turntable 26 has an identical angle of attack. As will be seen by comparison to the prior art impeller of FIG. 8, it is an important feature of the impeller of the present invention that it has an increased angle of attack 90. Impeller 34 is designed with a wedge shape that is more severe than prior art impellers. Wide end 50 of impeller 34 is much wider or deeper than prior art impellers. This creates a steeper angle for front side 54, i.e., a greater angle of attack 90, which exposes pocket 56 more to oncoming rocks. Compare impeller 34 of the present invention, as shown in FIG. 7 with a prior art impeller design shown in FIG. 8, and it will be seen that the angle of attack 90 is approximately twice the angle of attack 104 for the prior art impeller.

Figure 8:
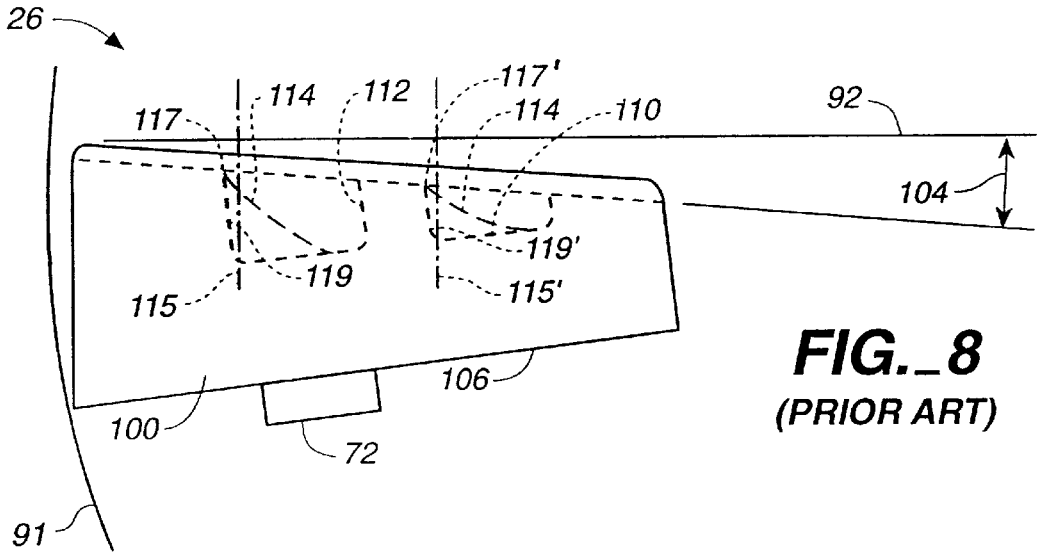
FIG. 8 (PRIOR ART)
FIG. 8 is a schematic view of a prior art impeller, showing the design of its pockets and its shallow angle of attack.

FIG. 8 shows a prior art impeller 100 mounted on turntable 26. Impeller 100 has a narrow, wide end 102 that is less than wide end 50 of impeller 34. Consequently, the angle of attack, included between radius 92 and wear surface 117 and shown by arrow 104, of prior art impeller 100, is significantly shallower than angle of attack 90 of impeller 34.

Impeller 34 is designed to be mounted on turntable 26 in the same orientation of back surface 52 as is back surface 106 of prior art impeller 100. Thus, the increased angle of attack 90 is preferably achieved. It will be understood that impeller 34 also could be provided with an increased angle of attack 90 by using a wedge shaped mounting washer (not shown). It is desirable, however, to employ the existing fixed mounting brackets 62 on rock crushers without having to use special washers or having to change the angle at which mounting brackets 62 are mounted to turntable 26. Both alternatives, however, are deemed to be broadly within the scope of the present invention.

At the present time, using pocket configuration 56, an angle of attack 90 of about 8 degrees has been found to be highly effective in retaining fines in pocket 56. Prior art impeller 100, for example, has an angle of attack 104 of 4 degrees. As angle 90 is increased abrasion will increase, but greater angles are possible using pocket configuration 56. Conversely, lesser angles of attack 90 are possible, but there is some greater tendency to lose fines out of pocket 56, which tendency can be resisted to some degree by shaping the pocket with an overhanging lip, which is described in more detail below.

FIG. 7 also illustrates the curved, C-shape of pocket 56 of the impeller of the present invention. Pocket 56 extends from a shallow end proximate end 48 of the impeller to a deepest end proximate end wall 59 and forms a transversely extending lip 111 defining the radially outermost edge of pocket 56. One advantage of a pocket which gradually increases in depth from the radially inner end toward the radially outer end is that rocks will impact the heel or innermost portion of the pocket at an oblique angle, causing less abrasion. Pocket 56 also is shaped with inner region 57 defined by concaved end wall 59 which extends radially outwardly beyond an imaginary line 113 that runs perpendicular to radial plane 92 and intersects the leading edge of lip 111. In operation, fines 116 build up in pocket 56 as rocks are impacted and thrown outwardly by the impeller. The negative or radially outwardly sloping pocket surface or end wall 59 below lip 111 helps trap fine 116 within the inner portion or region 57 of pocket 56. Such fines have to move against centrifugal forces on them, as well as against incoming rock and new fines in order to get around lip 111, which only happens to a limited extent. Thus, a collection of fines 116 always remains within pocket 56, which significantly improves the wear or abrasion resistance of impeller 34. As will be seen, the greater angle of attack 90 works in combination with the shape of pockets 56 to negatively or radially inwardly incline pocket surface 59 and enhance the effectiveness of lip 111 in retaining fines 116.

FIG. 8 illustrates the pocket design of prior art impeller 100. Impeller 100 includes a pair of pockets 110, 112 that are squared-off, as compared to the inwardly curved shape of pocket 56 of impeller 34. Imaginary lines 115, 115', like imaginary line 113, extend perpendicular to radial plane 92 and intersect the bottom edges of pockets 110, 112. The squared-off design and perpendicular orientation of pockets 110, 112 allows a certain amount of fines carried by rocks to build up within the pockets, as shown by broken lines 114, which indicates the amount of fines in the pockets. However, the positive or forward tilt of front walls 119, 119' of the pockets results in the escape of a significant amount of fines 114, which are simply forced by centrifugal forces and incoming rocks and fines over outer edges 117, 117' of pockets 110, 112. The combination of a small angle of attack 104 and the shape of pockets 110 and 112 makes it very unreliable as to whether or not fines will remain in the impeller pockets. The squared-off design of pockets 110, 112, therefore, works best for rock material having a high content of fines and moisture. Due to the forward or outward slope of walls 119, 119' only a small quantity of fines 114 normally can build up within the pockets and sometimes the pocket are swept clean. A substantial quantity of fines constantly escapes from pockets 110, 112, which requires the rocks to carry with them enough fines to replace the escaping fines and thereby maintain sufficient quantity of fines within the pockets to minimize wear on the impeller blade. Fines with high moisture content have greater capacity to stay within the pockets and, thus, maintain the wear resistant surface provided by the fines.

Figure 9:
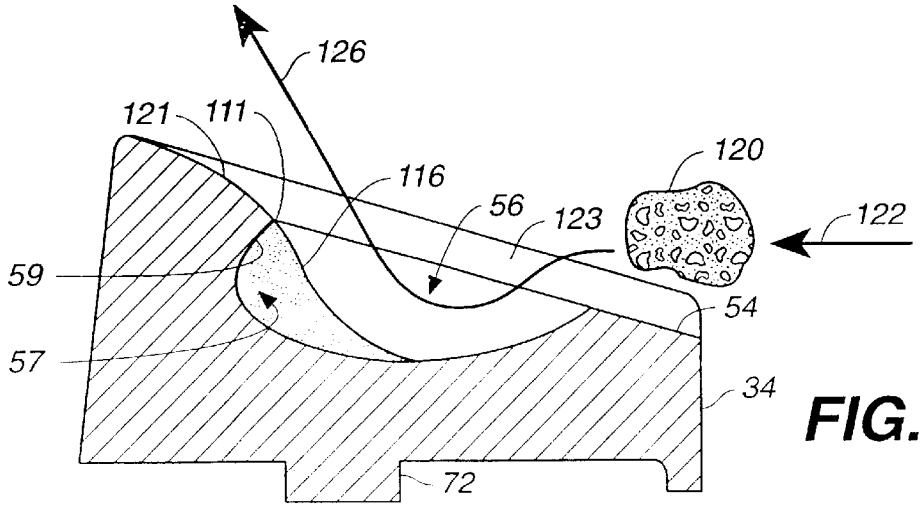
FIG. 9 is a sectional view of the impeller of FIG. 3, showing a buildup of fines within its pocket and the path of travel of a rock relative to an impeller.

FIG. 9 illustrates the path of a rock 120 relative to an impeller 34, which is shown by arrow 126. As the rock is moving off of the feed cone of the turntable and into the path of impeller 34, it is traveling in the direction indicated by arrow 122, which approximates a radial path from the turntable. As the rock moves into the path of the impellers (which in FIGS. 7–9 are shown rotating in a clockwise direction), the rock engages the impellers and are propelled clockwise by the impeller. As the rock moves outward toward pocket 56, the rock starts to move at least partially into the pocket, wherein the rock helps to pack the fines into the base of the pocket under lip 111. It is within the pocket region that the rock begins to rapidly accelerate. Normally, the impact of the rock with the impeller and its rapid change of direction and acceleration increases wear on the impeller surface. However, provision of a pocket of fines 116 at this point creates a renewable wear surface that isolates the impeller from abrasion. Radially outwardly or beyond the pocket region, the rock is contacted by a convex surface 121. Surface 121 causes rock 120 to continue to rapidly pick up speed, causing the impeller to act like a sling shot, hurling the rock outwardly off of the impeller in the direction of arrow 126.

Since the fines 116 within pocket region 57 are impacted by oncoming rock 120 and are also trapped by lip 111, rock 120 tends to compact the fines into the pocket. This results in the escape of fewer fines back into the stream of moving rocks. Consequently, impeller 34 works quite well with rocks having dry fine material, rocks having a minimal amount of fines and larger and harder rocks, than does prior art impeller 100.

The fines 116 provide a wear surface on the front side 54 of impeller 34 at the point where the rocks begin to rapidly pick up speed. The outer layer of fines are generally swept away with oncoming rocks, but subsequent fines land in the pocket and replace the escaping fines, thereby maintaining an evenly distributed wear surface of fines within the pocket. The fines deep within the inner portion 57 of pocket 56 remain trapped therein, thus ensuring a pocket of fines for engaging oncoming rocks.

As best may be seen in FIGS. 3 and 9, impeller 34 of the present invention further preferably has inwardly converging side walls, flanges or rails 123, 123' which extend radially along opposite sides of wear surfaces 54 pockets 56 and convex wear surface 121. Rails 123, 123' project in a circumferential direction and tend to catch rocks 120 and keep them from bouncing upwardly off the turntable, as well as converging or collecting the rocks and fines toward pocket 56. Such rails are broadly known in the prior art, as seen in FIG. 8, but in impeller 34 of the present invention side flanges or rails 123, 123' are formed with a greater depth and are formed to converge toward pocket 56.

As also may be seen in FIG. 3, impeller 34 may optionally be formed with a relieved or upwardly sloped side 125 proximate small end 48. This configuration allows inner small diameter end 48 of the impeller to be placed over the outer edge 127 of feed cone 46. Such a construction is optional, but in some centrifugal rock crushers feed cone 46 is held on turntable 26 by the inner ends 48 of impellers 34, for example, as shown in FIG. 10. Sloped or notched wall 125 allows the impellers to overlap the edge of the feed cone.

FIG. 10 illustrates operation of the rock crusher assembly. Rocks 120 land on feed cone 46 of turntable 26 and move radially outwardly, as indicated by arrows 122, into the path of rotating impellers 34. As rocks 120 reach the pocket regions 56 of impellers 34, they rapidly pick up speed and are propelled in a tangential direction, as indicated by arrows 124.

Anvils 40 are lined up so that they are substantially normal to direction of travel 124 of the oncoming rocks in order to create a head-on impact. Upon impacting the anvils, the rocks break apart into a multiplicity of small pieces, as indicated by arrows 130.

While the present invention has been described in connection with a process for crushing "rocks," the present invention is applicable to centrifugal crushing materials such as concrete, cement clinkers, coal, sulfur, soda ash, salt, asphalt, precious metal ores, as well as a wide range of rock aggregate. Consequently, the present invention is not meant to be limited to rocks and where the term "rocks" appears in the claims it is meant to cover other types of material suitable for crushing or breaking up. Also, in the claims the term "fines" is meant to cover particulate material that is significantly smaller than the material to be crushed or broken apart, and which particulate material is capable of being packed within the impeller pocket described herein.

The method of the present invention provides a way of retaining rock fines in the pocket of a pocket rock crusher impeller. In the present method a radially outermost wall 59 of the impeller pocket is oriented to tilt or slope radially inwardly to trap rock fine 116 against ejection from the pocket. Impeller 34 is secured in the present method to the rock crusher turntable within wall 59 oriented in a slightly inwardly tilted orientation. This can be accomplished by forming pocket 56 with a wall that will be inwardly sloped when mounted to a standard turntable, or by providing a mounting structure which orients wall 59 in an inwardly tilted orientation by increasing the angle of attack 90, or both.

The present method insures that centrifugal force on the fines tends to pack them in pocket 56, and that incoming rock further resists fines escape from the pocket. This allows harder rock and rock with fewer fines to be crushed using pocketed impellers, and allows the pocketed impellers to have a longer wear life as a result of using the fines as a replaceable wear surface.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

What is claimed is:

1. A rock hurling impact rock crusher comprising, a rotatable turntable including a center region adapted to receive a quantity of rocks and an outer region, a plurality of impellers mounted to the turntable at the outer region thereof for rotation of the impellers as the turntable is rotated, each of the impellers having a forwardly facing wear face substantially radially oriented relative to the turntable, a ring of anvils spaced outwardly of the impellers and substantially in vertical alignment therewith, each impeller having a body with a pocket formed in the wear face thereof, the pocket increasing in depth from a radially inner shallow end to a radially outer deepest end, and the pocket being defined at the radially outer end by a transversely extending lip and an end wall extending inwardly in the body from the lip in a radially outwardly extending direction, whereby fines carried with rocks being crushed collect within and are at least partially trapped by the pockets of the impellers.

2. The rock crusher of claim 1 wherein, the pocket gradually tapers in depth from the shallow end to the deepest end; and the end wall in the pocket is concaved with a portion thereof being radially outward of the lip.

3. The rock crusher of claim 1 wherein, the impeller is substantially wedge-shaped and the wear face on each impeller is oriented at an angle of attack exposing the wear surface and the pocket to oncoming rocks.

4. The rock crusher as defined in claim 3 wherein, the combination of the angle of attack and the shape of the pocket result in the end wall of the pocket extending inwardly from the lip in a radially outward direction.

5. The rock crusher of claim 1 wherein, the wear face of each impeller has an angle of attack of about 8 degrees.

6. The rock crusher as defined in claim 1 wherein, the wear face of the impeller included a convex surface radially outwardly of the pocket.

7. An impeller for use in a centrifugal impact rock crusher comprising:

an impeller body formed for mounting to a turntable of a centrifugal impact rock crusher with a front wear face substantially radially oriented so as engage and hurl rocks outwardly against an anvil when mounted on the turntable, and the body being further formed with a pocket providing a recess in the front wear face, the pocket tapering in depth from a shallow end to a deepest end, and the pocket being defined in part by a transversely extending end wall at the deepest end of the pocket, the body further being formed for mounting of the impeller to the turntable with the deepest end of the pocket in a radially outermost position and the end wall being radially outwardly inclined as said end wall extends inwardly into the body.

8. The impeller of claim 7 wherein, the end wall of the pocket is concaved.

9. The impeller of claim 7 wherein, the body of the impeller is formed for mounting of the impeller to the turntable with the wear face oriented at an angle of attack to a radial line from a center of the turntable of about 8 degrees.

10. The impeller of claim 7 wherein, the wear face includes a convex surface radially outwardly of the pocket.

* * * * *